US008645085B2

(12) United States Patent
Morris

(10) Patent No.: US 8,645,085 B2
(45) Date of Patent: Feb. 4, 2014

(54) SYSTEM AND METHOD FOR SIMULATING A BILLIARD CUE STROKE

(76) Inventor: Dustin Lee Morris, South Saint Paul, MN (US)

( * ) Notice: Subject to any disclaimer, the term of this patent is extended or adjusted under 35 U.S.C. 154(b) by 703 days.

(21) Appl. No.: 12/948,197

(22) Filed: Nov. 17, 2010

(65) Prior Publication Data

US 2011/0119021 A1 May 19, 2011

Related U.S. Application Data

(60) Provisional application No. 61/262,650, filed on Nov. 19, 2009.

(51) Int. Cl.

| | |
|---|---|
| ***G06F 17/40*** | (2006.01) |
| ***G06F 19/00*** | (2011.01) |
| ***G01L 5/00*** | (2006.01) |
| ***G01P 15/00*** | (2006.01) |
| ***A63D 15/00*** | (2006.01) |
| ***A63F 11/00*** | (2006.01) |

(52) U.S. Cl.

USPC ..... 702/41; 73/865.4; 273/108; 273/108.1; 340/665; 340/670; 463/1; 473/1; 473/2; 702/1; 702/33; 702/127; 702/141; 702/182; 702/187; 702/189

(58) Field of Classification Search

USPC ..... 73/12.01, 12.04, 379.01, 379.04, 432.1, 73/488, 514.01, 570, 649, 865.4, 865.8, 73/866.3; 273/108, 108.1, 440; 340/500, 340/540, 573.1, 665, 670; 345/156; 463/1, 463/7, 9; 473/1, 2, 44; 702/1, 33, 41, 127, 702/141, 142, 182, 187, 189; 708/100, 105, 708/200; 715/700, 704

IPC .... A63D 15/00,155/006, 15/08, 2015/00; A63F 7/00, 7/0005, 11/00, 2007/00, 2007/0005, A63F 2011/00, 2250/00, 2250/10; G01D 7/00, G01D 9/00, 21/00; G01L 1/00, 5/00, 5/0052; G01P 1/00, 1/06, 13/00, 15/00, 2015/00; G06F 11/00, 11/30, 11/32, 11/34, 17/00, 17/40, G06F 19/00

See application file for complete search history.

(56) References Cited

U.S. PATENT DOCUMENTS

| | | | | | |
|---|---|---|---|---|---|
| 2,708,577 | A | * | 5/1955 | Bunka | 473/2 |
| 3,270,564 | A | * | 9/1966 | Evans | 73/865.4 |
| 5,056,783 | A | * | 10/1991 | Matcovich et al. | 473/453 |
| 5,233,544 | A | * | 8/1993 | Kobayashi | 702/141 |
| 5,694,340 | A | * | 12/1997 | Kim | 702/141 |
| 5,779,555 | A | * | 7/1998 | Nomura et al. | 473/223 |

* cited by examiner

*Primary Examiner* — Edward Cosimano
(74) *Attorney, Agent, or Firm* — Stanley J. Pawlik

(57) ABSTRACT

A billiard cue stroke simulator includes a wireless acceleration sensing device and a computing system. The wireless acceleration sensing device measures acceleration of a billiard cue along two or more axes of a coordinate system during a stroke of the billiard cue and generates acceleration data including the acceleration data. Additionally, the wireless acceleration sensing device transmits a wireless communication signal including the acceleration data to the computing system. The computing system generates image data indicating movement of the billiard cue during the stroke of the billiard cue based on the acceleration data and displays the image data. In this way, the billiard cue stroke simulator simulates the stroke of the billiard cue.

23 Claims, 7 Drawing Sheets

SYSTEM AND METHOD FOR SIMULATING A BILLIARD CUE STROKE

CROSS-REFERENCE TO RELATED APPLICATION

This application claims benefit of U.S. provisional patent application Ser. No. 61/262,650 filed Nov. 19, 2009 and entitled "SYSTEM AND METHOD FOR SIMULATING A BILLIARD CUE STROKE," which is incorporated herein by reference in its entirety.

BACKGROUND

In a game of billiards, a player typically uses a billiard cue to strike a billiard ball lying on a billiard table. As a result, the billiard ball is set in motion across the billiard table. The player's act of moving the billiard cue to strike the billiard ball is often referred to as the player's stroke of the billiard cue. Moreover, the stroke determines characteristics affecting the motion of the billiard ball, such as an initial velocity, direction, and spin of the billiard ball after contact with the billiard cue.

Generally, a player can view only a portion of a billiard cue when making a stroke with the billiard cue. For instance, a player can ordinarily see only a portion of the billiard cue when using both hands to stroke the billiard cue. Moreover, a player typically focuses his or her view on a tip of the billiard cue used for striking the billiard ball during the stroke. Because a player can ordinarily view only a portion of a billiard cue when making a stroke with the billiard cue, the player cannot see the motion of the entire cue during the stroke. Additionally, a fast stoke and follow through does not allow for the player to perceive fine movements of the cue during the stroke. Consequently, it is difficult for the player to evaluate his or her stroke of the billiard cue.

In light of the above, a need exists for a system and method of evaluating a billiard cue stroke.

SUMMARY

In various embodiments, a billiard cue stroke simulator includes a wireless acceleration sensing device and a computing system. The wireless acceleration sensing device measures acceleration of a billiard cue along two or more axes of a coordinate system during a stroke of the billiard cue and generates acceleration data based on the sensed acceleration data. Additionally, the wireless acceleration sensing device transmits a wireless communication signal including the acceleration data to the computing system. In turn, the computing system generates image data indicating movement of the billiard cue during the stroke of the billiard cue based on the acceleration data and displays the image data. In this way, the billiard cue stroke simulator simulates the stroke of the billiard cue.

A billiard cue stroke simulator, in accordance with one embodiment, includes a wireless acceleration sensing device for attaching to a billiard cue. The wireless acceleration sensing device is configured to generate acceleration data indicating acceleration of the billiard cue during a stroke of the billiard cue and generates a wireless communication signal including the acceleration data. The billiard cue stroke simulator further includes a computing system configure to receive the wireless communication signal. The computing system is further configured to generate image data indicating movement of the billiard cue based on the acceleration data in the wireless communication signal. Additionally, the computing system is configured to display at least one image indicating movement of the billiard cue based on the image data. For example, the computing system may display real-time movement of the billiard cue.

A billiard cue stroke simulator, in accordance with one embodiment, includes a means for generating acceleration data indicating acceleration of a billiard cue during a stroke of the billiard cue. The billiard cue stroke simulator further includes a means for generating a wireless communication signal including the acceleration data. Additionally, the billiard cue stroke simulator includes a means for generating image data indicating movement of the billiard cue based on the acceleration data in the wireless communication signal. Further, the billiard cue stroke simulator includes a means for displaying at least one image indicating movement of the billiard cue along at least two axes of the coordinate system based on the image data.

A method of simulating a billiard cue stroke, in accordance with one embodiment, includes generating acceleration data indicating acceleration of a billiard cue during a stroke of the billiard cue and generating a wireless communication signal including the acceleration data. The method also includes generating image data indicating movement of the billiard cue based on the acceleration data in the wireless communication signal. Additionally, the method includes displaying at least one image indicating movement of the billiard cue along at least two axes of the coordinate system based on the image data.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DETAILED DESCRIPTION

In various embodiments, a billiard cue stroke simulator measures acceleration of a billiard cue along two or more axes of a coordinate system during a stroke of the billiard cue and generates acceleration data including the acceleration data. Additionally, the billiard cue stroke simulator generates image data indicating movement of the billiard cue during the stroke of the billiard cue based on the acceleration data and displays the image data. In this way, the billiard cue stroke simulator simulates the stroke of the billiard cue. Various embodiments of the present invention are discussed in U.S. provisional patent application Ser. No. 61/262,650 filed Nov. 19, 2009 and entitled "SYSTEM AND METHOD FOR SIMULATING A BILLIARD CUE STROKE," which is incorporated herein by reference in its entirety.

Figure 1:
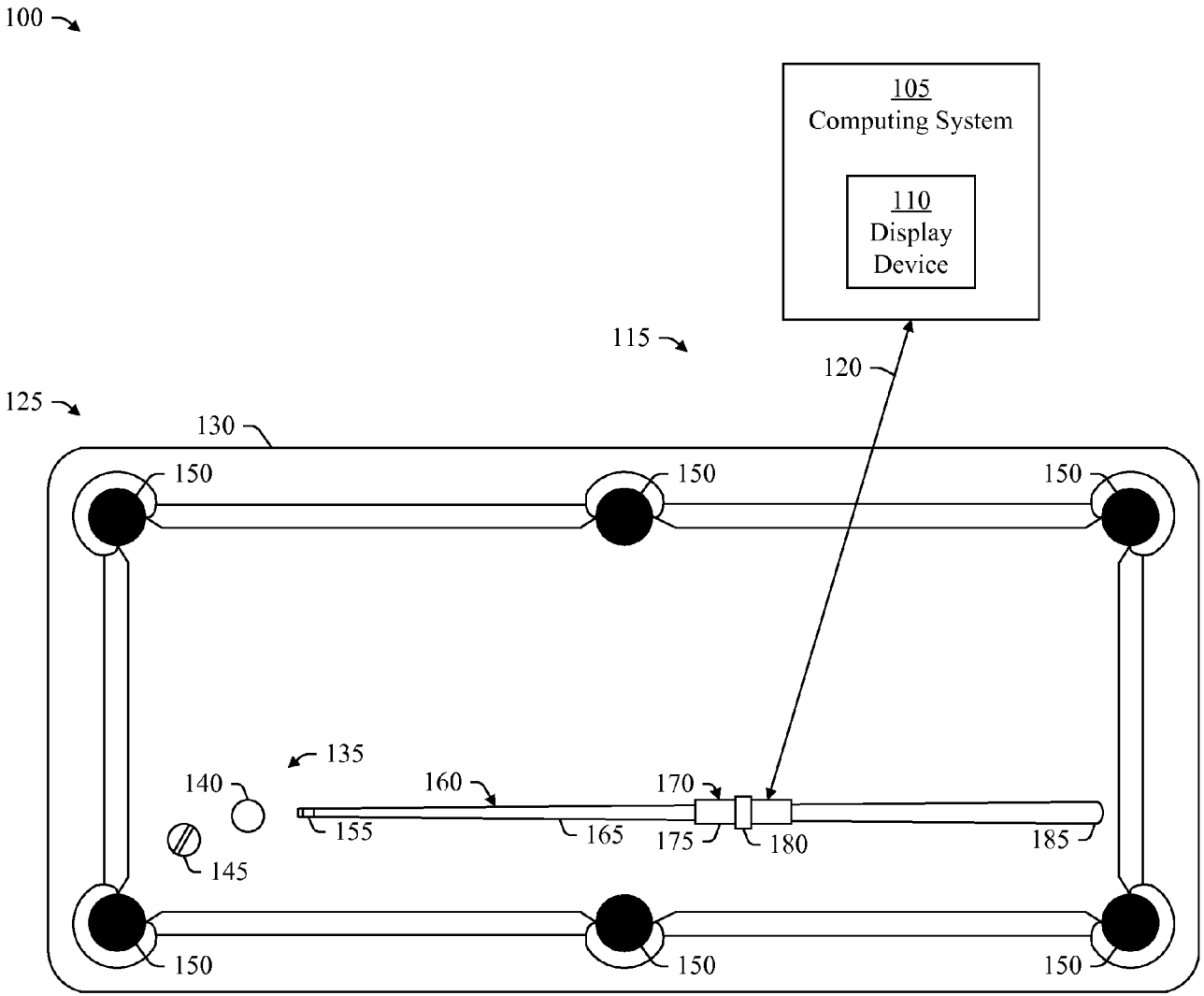
FIG. 1 is a block diagram of a simulation environment including billiard equipment and a billiard cue stroke simulator, in accordance with an embodiment of the present invention.

FIG. 1 illustrates a simulation environment 100, in accordance with an embodiment of the present invention. The simulation environment 100 includes billiard equipment 125 and a billiard cue stroke simulator 115. The billiard equipment 125 includes a billiard table 130, billiard balls 135, and a billiard cue 160. The billiard balls 135 include a cue ball 140 and an object ball 145. Moreover, the billiard table 130 includes pockets 150 for receiving the billiard balls 135. The billiard cue 160 includes a tip 155, a shaft 165, and a butt 185. The butt 185 defines one end of the shaft 165 and the tip 155 is attached to the other end of the shaft 165. As may be envisioned from FIG. 1, a player may line up the billiard cue 160 and stroke the billiard cue 160 such that the tip 155 of the billiard cue 160 strikes (i.e., contacts) the cue ball 140 and sets the cue ball 140 in motion across the billiard table 130. As may also be envisioned from FIG. 1, the cue ball 140 may in turn strike the object ball 145 and set the object ball 145 in motion across the billiard table 130 and into the pocket 150 of the billiard table 130.

The billiard cue stroke simulator 115 includes a computing system 105 and a wireless acceleration sensing device 170. The computing system 105 includes a display device 110. For example, the display device 110 may be a cathode-ray tube (CRT), a liquid crystal display (LCD), a light-emitting diode (LED) display, or the like. The wireless acceleration sensing device 170 includes a housing 175 and an attachment device 180 mounted to the housing 175 for attaching the wireless acceleration sensing device 170 to the shaft 165 of the billiard cue 160. In operation, the wireless acceleration sensing device 170 measure acceleration of the billiard cue 160 and generates acceleration data based on the measured acceleration data. Moreover, the acceleration data indicates the acceleration of the billiard cue 160. The wireless acceleration sensing device 170 transmits the acceleration data to the computing system 105 via a wireless communication signal 120. In turn, the computing system 105 displays images based on the acceleration data in the wireless communication signal 120 received from the wireless acceleration sensing device 170.

In various embodiments, the computing system 105 computes movement (e.g., a trajectory) of the billiard cue 160 based on the acceleration data received from the wireless acceleration sensing device 170 and displays images based on the computed movement (e.g., computed trajectory) on the display device 110. In some embodiments, the computing system 105 computes the movement (e.g., trajectory) of the billiard cue 160 in real-time and displays images based on the computed movement (e.g., computed trajectory) on the display device 110 in real-time. In some embodiments, the computing system 105 stores the acceleration data received from the wireless acceleration sensing device 170, computes the movement (e.g., trajectory) of the billiard cue 160 based on the acceleration data, and displays images indicating the computed movement (e.g., trajectory) of the billiard cue 160 on the display device 110. For example, the wireless acceleration sensing device 170 may include controls, such as electromechanical or electrical switches, for initiating and terminating the generation of the acceleration data. As another example, the wireless acceleration sensing device 170 may include controls for initiating or terminating transmission of the acceleration data to the computing system 105, or both.

In some embodiments, the wireless acceleration sensing device 170 transmits the acceleration data to the computing system 105 during generation of the acceleration data. In this way, the wireless acceleration sensing device 170 transmits the acceleration data to the computing system 105 in real-time. In some embodiments, the wireless acceleration sensing device 170 stores the acceleration data and subsequently sends the acceleration data to the computing system 105. For example, the wireless acceleration sensing device 170 may begin generating the acceleration data in response to a control of the wireless acceleration sensing device 170 and stop generating the acceleration data in response to a control of the wireless acceleration sensing device 170.

In this example, the wireless acceleration sensing device 170 stores the acceleration data between the period in which the wireless acceleration sensing device 170 starts generating the acceleration data and stops generating the acceleration data. Further in this example, the wireless acceleration sensing device 170 transmits the acceleration data stored in the wireless acceleration sensing device 170 to the computing system 105 via the wireless communication signal 120 in response to another control of the wireless acceleration sensing device 170. In some embodiments, the wireless acceleration sensing device 170 transmits the acceleration data to the computing system 105 in discrete portions during generation of the acceleration data. In this way, the wireless acceleration sensing device 170 transmits the acceleration data to the computing system 105 in real-time.

In various embodiments, the computing system 105 may simulate movement of the billiard cue 160 by displaying images of a representation of the billiard cue 160 (e.g., a simulated billiard cue) on the display device 110 of based on the acceleration data. For example, the computing system 105 may display images showing movement of a simulated billiard cue representing the movement of billiard cue 160. In this way, player may view the images on the display device 110 and evaluate the stroke of the billiard cue 160 based on the images. Accordingly, the billiard cue stroke simulator 115 functions as a training system which provides feedback on a player's stroke of the billiard cue 160. Moreover, the player may use the billiard cue stroke simulator 115 to improve the player's stroke of the billiard cue 160.

In various embodiments, the computing system 105 displays movement of the billiard cue 160 by displaying graphs or charts of the movement (e.g., trajectory), or both. For example, the computing system 105 may display a graph indicating the position of the billiard cue 160 along an x-axis over time, a graph indicating the position of the billiard cue 160 along a y-axis over time, or a graph indicating the position of the billiard cue 160 along a z-axis over time, or some combination thereof. In some embodiments, the computing system 105 may display images showing movement of a simulated billiard cue representing the billiard cue 160 along with one or more graphs of the position of the billiard cue 160 over time (e.g., the position of the billiard cue 160 over time along an x-axis, a y-axis, and a z-axis).

In some embodiments, the billiard cue stroke simulator 115 includes more than one wireless acceleration sensing device 170. In one embodiment, the billiard cue stroke simulator 115 includes two wireless acceleration sensing devices 170 for improving accuracy in computing the movement of the billiard cue 160. In this embodiment, one of the wireless acceleration sensing devices 170 is attached to the shaft 165 closer to the tip 155 of the billiard cue 160 and the other wireless acceleration sensing device 170 is attached to the shaft 165 closer to the butt 185 of the billiard cue 160. Moreover, the computing system 105 computes the movement of the billiard cue 160 based on the acceleration data generated by both of the wireless acceleration sensing devices 170.

In further embodiments, a user inputs a distance between the wireless acceleration sensing devices 170 into the computing system 105. In turn, the computing system 105 computes the movement of the billiard cue 160 based on the distance between the wireless acceleration sensing devices 170 and the acceleration data generated by both of the wireless acceleration sensing devices 170.

Figure 2:
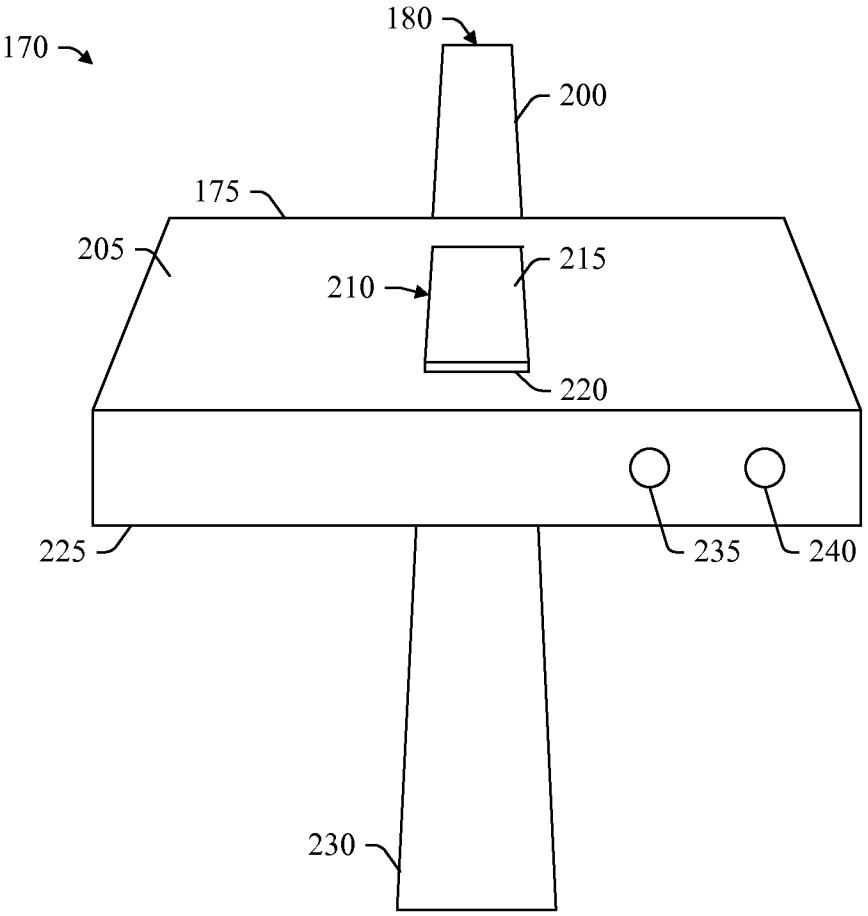
FIG. 2 is a perspective view of a wireless acceleration sensing device, in accordance with an embodiment of the present invention.

FIG. 2 illustrates the wireless acceleration sensing device 170, in accordance with an embodiment of the present invention. In addition to the housing 175 and the attachment device 180, the wireless acceleration sensing device 170 includes an elastic member 210. The elastic member 210 has a front surface 215 and a back surface 220 substantially parallel to the front surface 215. Moreover, the housing 175 of the wireless acceleration sensing device 170 includes a front surface 205 and a back surface 225.

The back surface 220 of the elastic member 210 is mounted to the front surface 205 of the housing 175 and is substantially parallel to the front surface 205 of the housing 175. The attachment device 180 is mounted to the back surface 225 of the housing 175 and includes a proximal end 230 and a distal end 200. In various embodiments, the attachment device 180 is a strap for attaching the housing 175 of the wireless acceleration sensing device 170 to the shaft 165 of the billiard cue 160 such that the front surface 215 of the elastic member 210 contacts the shaft 165 of the billiard cue 160. For example, the attachment device 180 may be a strap having a connector made of Velcro™ for connecting the proximal end 230 of the attachment device 180 to the distal end 200 of the attachment device 180. In this example, the proximal end 230 of the attachment device 180 is connected to the distal end 200 of the attachment device 180 to form a loop around the shaft 165 of the billiard cue 160. In other embodiments, the attachment device 180 may include a buckle or some other mechanism for attaching the wireless acceleration sensing device 170 to the billiard cue 160.

In various embodiments, the attachment device 180 allows the wireless acceleration sensing device 170 to be quickly and conveniently attached to the shaft 165 of the billiard cue 160 and inhibits (e.g., prevents) rotation of the housing 175 about the shaft 165 of the billiard cue 160. For example, the elastic member 210 may be composed of rubber or foam that conforms to the shaft 165 of the billiard cue 160 when the housing 175 of the wireless acceleration sensing device 170 is attached to the billiard cue 160 and has a sufficiently high coefficient of friction to inhibit (e.g., prevent) rotation of the housing 175 about the shaft 165 of the billiard cue 160. Additionally, the attachment device 180 allows the wireless acceleration sensing device 170 to be quickly and conveniently detached from the shaft 165 of the billiard cue 160.

In some embodiments, the wireless acceleration sensing device 170 includes a switch 235 mounted to the housing 175. For example, the switch 235 may be a push button switch. In these embodiments, a user may activate (e.g., push) the switch 235 to indicate the start of a time period for measuring acceleration data of the billiard cue 160 and activate (e.g., push) the switch 235 again to indicate the end of the time period. In these embodiments, the wireless acceleration sensing device 170 starts measuring acceleration of the billiard cue 160 at the start of the time period based on the initial activation of the switch 235 and stops measuring acceleration of the billiard cue 160 at the end of the time period based on the subsequent activation of the switch 235.

In further embodiments, the wireless acceleration sensing device 170 includes a visual indicator 240 mounted to the housing 175 for indicating when the wireless acceleration sensing device 170 is measuring acceleration of the billiard cue 160. For example, the visual indicator 240 may be a light or a light emitting diode (LED) that emits light in the visible spectrum when the wireless acceleration sensing device 170 is measuring acceleration of the billiard cue 160.

In various embodiments, the billiard cue 160 has a length measured along an axis of the shaft 165 between the tip 155 and the butt 185 of the billiard cue 160. Additionally, the billiard cue 160 has a width measured at a midpoint between the tip 155 and the butt 185. Furthermore, the housing 175 has a width that is substantially the same as the width of the billiard cue 160 when the wireless acceleration sensing device 170 is attached to the billiard cue 160. In various embodiments, the width of the housing 175 is less than twice the width of the billiard cue 160. In some embodiments, the width of the housing is less than the width of the butt 185 of the billiard cue 160.

Figure 3:
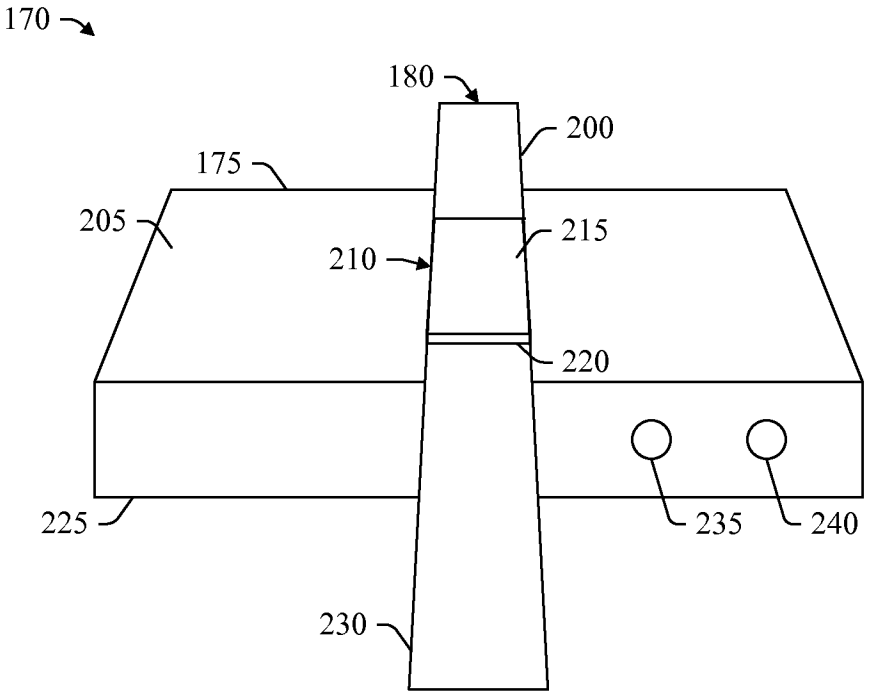
FIG. 3 is a perspective view of a wireless acceleration sensing device, in accordance with an embodiment of the present invention.

FIG. 3 illustrates the wireless acceleration sensing device 170, in accordance with an embodiment of the present invention. As illustrated in FIG. 3, the wireless acceleration sensing device 170 includes the housing 175, the attachment device 180, the wireless acceleration sensing device 170, and the elastic member 210. The wireless acceleration sensing device 170 illustrated in FIG. 3 is similar to the wireless acceleration sensing device 170 illustrated in FIG. 2, but the attachment device 180 is mounted to the front surface 205 of the housing 175 instead of the back surface 225 of the housing 175. Additionally, the back surface 220 of the elastic member 210 is mounted to the attachment device 180 instead of the front surface 205 of the housing 175. As illustrated in FIG. 3, the attachment device 180 contacts and is between both the front surface 205 of the housing 175 and the back surface 220 of the elastic member 210.

Figure 4:
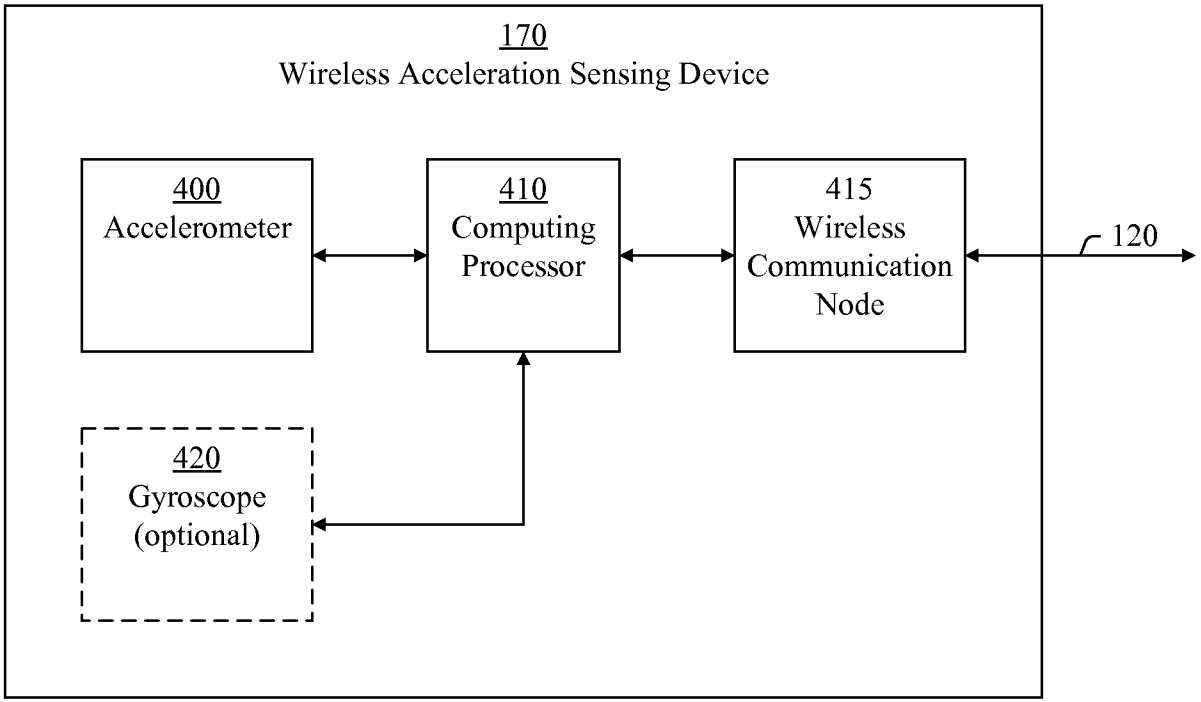
FIG. 4 is a block diagram of a wireless acceleration sensing device, in accordance with an embodiment of the present invention.

FIG. 4 illustrates the wireless acceleration sensing device 170, in accordance with an embodiment of the present invention. The wireless acceleration sensing device 170 includes an accelerometer 400, a computing processor 410, and a wireless communication node 415. The computing processor 410 is coupled to the accelerometer 400 and the wireless communication node 415.

In operation, the accelerometer 400 measures acceleration of the billiard cue 160 when the wireless acceleration sensing device 170 is attached to the billiard cue 160. In this way, the accelerometer 400 generates acceleration data indicating the acceleration of the billiard cue 160. In various embodiments, the accelerometer 400 is programmable. For example, the accelerometer 400 may be programmable to have an acceleration level of plus or minus two gravitational forces (+/−2 g), plus or minus four gravitational forces (+/−4 g), or plus or minus eight gravitational forces (+/−4 g). In these embodiments, the computing processor 410 programs the acceleration level of the accelerometer 400, for example based on user input to the billiard cue stroke simulator 115.

The accelerometer 400 provides the acceleration data to the computing processor 410, and the computing processor 410 provides the acceleration data to the wireless communication node 415. In turn, the wireless communication node 415 transmits the acceleration data to the computing system 105 via the wireless communication signal 120. The accelerometer 400 may include any circuitry for measuring acceleration in at least two directions of a coordinate system. In some embodiments, the accelerometer 400 generates acceleration data in two dimensions, for example along an x-axis and along a y-axis of an x-y coordinate system. In some embodiments, the accelerometer 400 generates acceleration data in three dimensions, for example along an x-axis, a y-axis, and a z-axis of an x-y-z coordinate system. For example, the accelerometer 400 may be an x-y-z axis accelerometer identified by part number MMA7455L, which is available from Freescale Semiconductor of Austin, Tex.

The computing processor 410 may include any circuitry for receiving acceleration data from the accelerometer 400 and providing the acceleration data to the wireless communication node 415. For example, the computing processor 410 may be a microprocessor, an embedded processor, an embedded controller, a microcontroller, a synchronous logic circuit, an asynchronous logic circuit, a state machine, or the like, or some combination thereof. In some embodiments, the computing processor 410 is a Pic Microcontroller available from Microchip of Chandler, Ariz. For example, the computing processor 410 may be a PIC18F14K22 microcontroller. In some embodiments, the computing processor 410 processes the acceleration data before providing the acceleration data to the wireless communication node 415. For example, the computing processor 410 may filter, format, compress, or encode the acceleration data, or some combination thereof. In some embodiments, the computing processor 410 includes a memory device for storing the acceleration data, for example a random-access memory (RAM) or a flash storage. In other embodiments, the memory device is external of the computing processor 410.

The wireless communication node 415 may be any circuitry for generating the wireless communication signal 120 including the acceleration data. For example, the wireless communication node 415 may generate an oscillating signal at a transmit frequency and modulate the oscillating signal with the acceleration data to generate the wireless communication signal 120. In various embodiments, the wireless communication signal 120 may be an analog signal or a digital signal. In some embodiments, the wireless communication node 415 generates the wireless communication signal 120 according to a wireless area network (WAN) standard or a personal wireless area network standard (PWAN). For example, the wireless communication node 415 may generate the wireless communication signal 120 according to a Bluetooth standard, an Infrared Data Association (IrDA) standard, an ultra-wideband (UWB) standard, a Z-Wave standard, or a ZigBee standard. In some embodiments, the wireless communication node 415 is a radio transmitter that transmits the wireless communication signal 120 according to the IEEE 802.15.4-2003 standard for personal wireless networks. In some embodiments, the wireless communication node 415 is a radio transceiver that receives and transmits the wireless communication signal 120 according to the IEEE 802.15.4-2003 standard for personal wireless networks.

In various embodiments, the wireless acceleration sensing device 170 includes a device, such as a push button switch, for determining a time period over which the wireless acceleration sensing device 170 measures acceleration of the billiard cue 160 and generates the acceleration data. For example, a user of the billiard cue stroke simulator 115 may push a button of a push button switch on the wireless acceleration sensing device 170 indicating that the wireless acceleration sensing device 170 is to begin measuring the acceleration of the billiard cue 160 and the user may then push the button again, or push a button of another push button switch, indicating that the wireless acceleration sensing device 170 is to stop measuring acceleration of the billiard cue 160. In this way, the wireless acceleration sensing device 170 determines the time period of the acceleration data. Moreover, the user controls the time period for the images displayed by the display device 110. For example, the user may control the time period to include practice strokes of the billiard cue 160 in which the tip 155 of the billiard cue 160 does not contact the cue ball 140 as well as the actual stroke of the billiard cue 160 in which the tip 155 of the billiard cue 160 contacts the cue ball 140.

In various embodiments, the wireless acceleration sensing device 170 includes an optional gyroscope 420 coupled to the computing processor 410. In these embodiments, the acceleration data transmitted by the wireless acceleration sensing device 170 to the computing system 105 includes measurements made by the gyroscope 420. In turn, the computing system 105 generates images showing movement of the billiard cue 160 based on the acceleration data and displays the images.

In some embodiments, the gyroscope 420 measures side-to-side movement (i.e., yaw) about an axis extending in a direction of primary movement of the billiard cue 160. For example, the axis may extend from the tip 155 to the butt 185 of the billiard cue 160 at the time that the billiard cue 160 contacts the cue ball 140. In other embodiments, the gyroscope 420 measures an angle of rotation around the axis of primary movement of the billiard cue 160. In some embodiments, the gyroscope 420 measures side-to-side movement about the axis of primary movement of the billiard cue 155 as well as an angle of rotation around the axis. Although one gyroscope 420 is illustrated in FIG. 4, the wireless acceleration sensing device 170 may include more than one gyroscope 420 in other embodiments.

Figure 5:
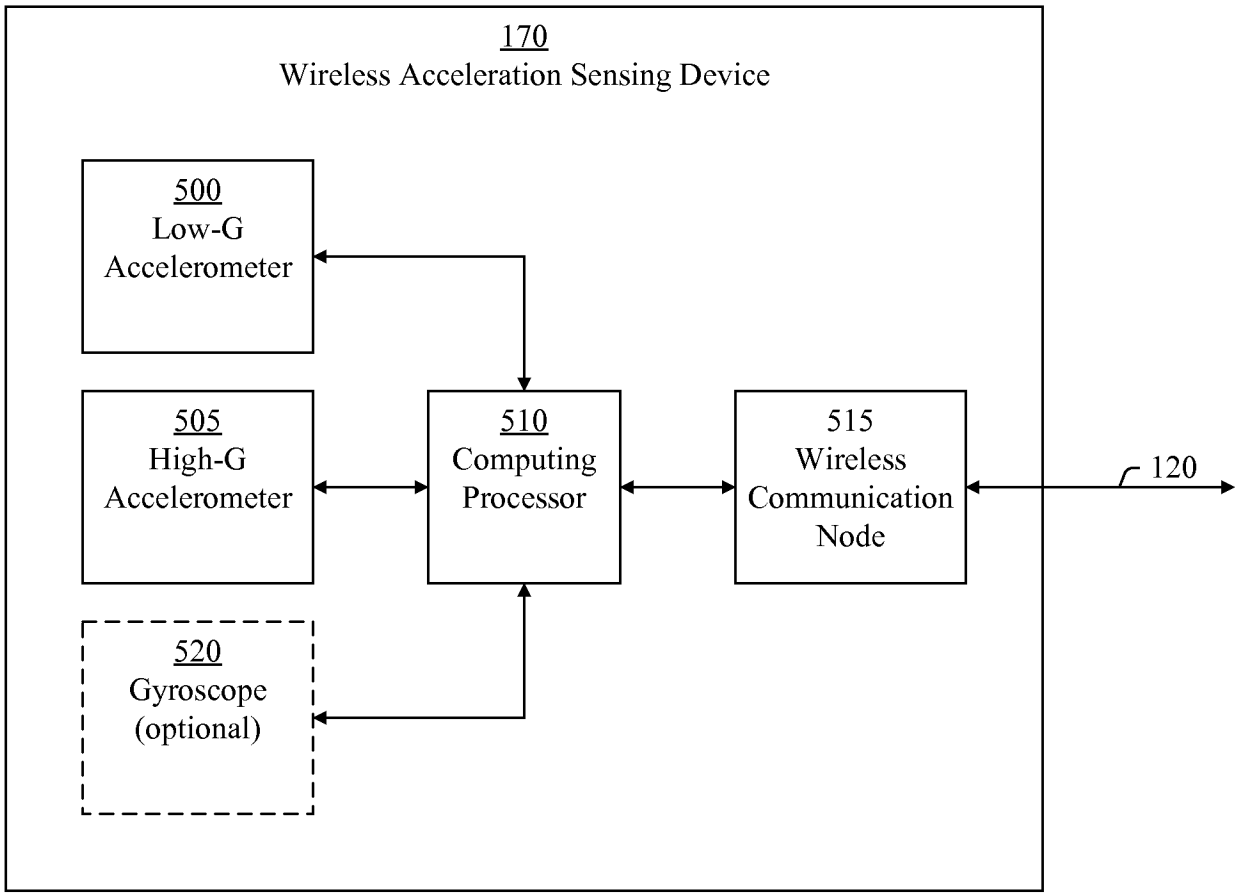
FIG. 5 is a block diagram of a wireless acceleration sensing device, in accordance with an embodiment of the present invention.

FIG. 5 illustrates the wireless acceleration sensing device 170, in accordance with an embodiment of the present invention. The wireless acceleration sensing device 170 includes a low-g accelerometer 500, a high-g accelerometer 505, a computing processor 510, and a wireless communication node 515. The computing processor 510 is coupled to the low-g accelerometer 500, the high-g accelerometer 505, and the wireless communication node 515.

In operation, each of the low-g accelerometer 500 and the high-g accelerometer 505 measures acceleration of the billiard cue 160 when the wireless acceleration sensing device 170 is attached to the billiard cue 160. In this way, the low-g accelerometer 500 and the high-g accelerometer 505 together generate acceleration data indicating the acceleration of the billiard cue 160. The acceleration data includes both low-level acceleration data and high-level acceleration data. For example, the low-level acceleration data may indicate a low-level acceleration of the billiard cue 160, such as plus or minus two gravitational forces (+/−2 g) and the high-level acceleration data may indicate a high-level acceleration of the billiard cue 160, such as plus or minus eight gravitational forces (+/−8 g). In this embodiment, the low-g accelerometer 500 generates low-level acceleration data and the high-g accelerometer 505 generates high-level acceleration data.

In various embodiments, the low-g accelerometer 500 and the high-g accelerometer 505 are programmable. For example, each of the low-g accelerometer 500 and the high-g accelerometer 505 may be programmable to have an acceleration level of plus or minus two gravitational forces (+/−2 g), plus or minus four gravitational forces (+/−4 g), or plus or minus eight gravitational forces (+/−8 g). In these embodiments, the computing processor 510 programs the acceleration levels of the low-g accelerometer 500 and the high-g accelerometer 505, for example based on user input to the billiard cue stroke simulator 115. Moreover, the computing processor 510 programs the low-g accelerometer 500 and the high-g accelerometer 505 so that the acceleration level of the low-g accelerometer 500 is less than the acceleration level of the high-g accelerometer 505.

The low-g accelerometer 500 provides the low-level acceleration data to the computing processor 510 and the high-g accelerometer 505 provides the high-level acceleration data to the computing processor 510. The computing processor 510 provides the acceleration data, including the low-level acceleration data and the high-level acceleration data, to the wireless communication node 515. In turn, the wireless communication node 515 transmits the acceleration data to the computing system 105 via the wireless communication signal 120.

The low-g accelerometer 500 may include any circuitry for measuring acceleration in at least two directions of a coordinate system. In some embodiments, the low-g accelerometer 500 generates acceleration data in two dimensions, for example along an x-axis and along a y-axis of an x-y coordinate system. Similarly, the high-g accelerometer 505 may include any circuitry for measuring acceleration in at least two directions of a coordinate system. In some embodiments, the high-g accelerometer 505 generates acceleration data in two dimensions, for example along an x-axis and along a y-axis of an x-y coordinate system.

In some embodiments, the low-g accelerometer 500 or the high-g accelerometer 505, or both, generate acceleration data in three dimensions, for example along an x-axis, a y-axis, and a z-axis of an x-y-z coordinate system. For example, each of the low-g accelerometer 500 and the high-g accelerometer 505 may be an x-y-z axis accelerometer identified by part number MMA7455L, which is available from Freescale Semiconductor of Austin, Tex.

The computing processor 510 may include any circuitry for receiving acceleration data from the low-g accelerometer 500 and the high-g accelerometer 505, and providing the acceleration data to the wireless communication node 515. For example, the computing processor 510 may be a microprocessor, an embedded processor, an embedded controller, a microcontroller, a synchronous logic circuit, an asynchronous logic circuit, a state machine, or the like, or some combination thereof. In some embodiments, the computing processor 510 is a Pic Microcontroller available from Microchip of Chandler, Ariz. For example, the computing processor 510 may be a PIC18F14K22 microcontroller. In some embodiments, the computing processor 510 processes the acceleration data before providing the acceleration data to the wireless communication node 515. For example, the computing processor 510 may filter, format, compress, combine, or encode the acceleration data, or some combination thereof. In some embodiments, the computing processor 510 includes a memory device for storing the acceleration data, for example a random-access memory (RAM) or a flash storage. In other embodiments, the memory device is external of the computing processor 510.

The wireless communication node 515 may be any circuitry for generating the wireless communication signal 120 including the acceleration data. For example, the wireless communication node 515 may generate an oscillating signal at a transmit frequency and modulate the oscillating signal with the acceleration data to generate the wireless communication signal 120. In various embodiments, the wireless communication signal 120 may be an analog signal or a digital signal. In some embodiments, the wireless communication node 515 generates the wireless communication signal 120 according to a wireless area network (WAN) standard or a personal wireless area network standard (PWAN). For example, the wireless communication node 515 may generate the wireless communication signal 120 according to a Bluetooth standard, an Infrared Data Association (IrDA) standard, an ultra-wideband (UWB) standard, a Z-Wave standard, or a ZigBee standard. In some embodiments, the wireless communication node 515 is a radio transmitter that transmits the wireless communication signal 120 according to the IEEE 802.15.4-2003 standard for personal wireless networks. In some embodiments, the wireless communication node 515 is a radio transceiver that receives and transmits the wireless communication signal 120 according to the IEEE 802.15.4-2003 standard for personal wireless networks.

In various embodiments, the wireless acceleration sensing device 170 includes an optional gyroscope 520 coupled to the computing processor 510. In these embodiments, the acceleration data transmitted by the wireless acceleration sensing device 170 to the computing system 105 includes measurements made by the gyroscope 520. In turn, the computing system 105 generates images showing movement of the billiard cue 160 based on the acceleration data and displays the images.

In some embodiments, the gyroscope 520 measures side-to-side movement (i.e., yaw) about an axis extending in a direction of primary movement of the billiard cue 160. For example, the axis may extend from the tip 155 to the butt 185 of the billiard cue 160 at the time that the billiard cue 160 contacts the cue ball 140. In other embodiments, the gyroscope 520 measures an angle of rotation around the axis of primary movement of the billiard cue 160. In some embodiments, the gyroscope 520 measures side-to-side movement about the axis of primary movement of the billiard cue 155 as well as an angle of rotation around the axis. Although one gyroscope is illustrated in FIG. 5, the wireless acceleration sensing device 170 may include more than one gyroscope 520 in other embodiments.

Figure 6:
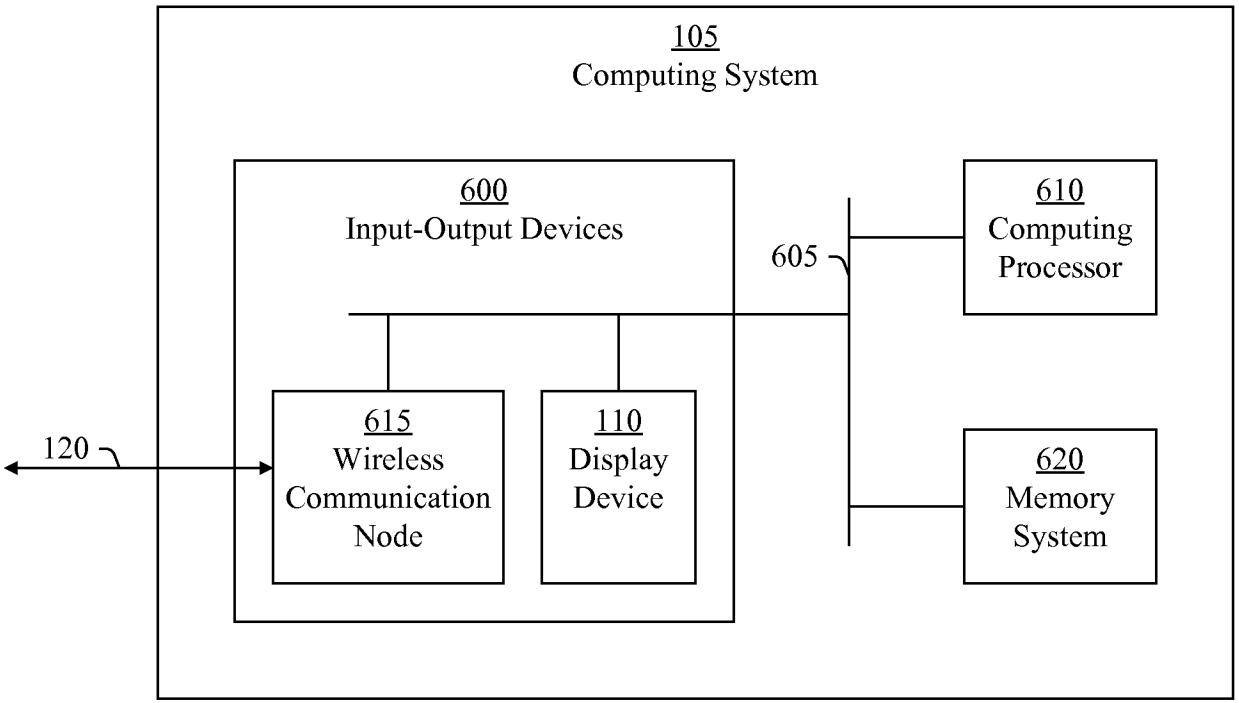
FIG. 6 is a block diagram of a computing system, in accordance with an embodiment of the present invention.

FIG. 6 illustrates the computing system 105, in accordance with an embodiment of the present invention. The computing system 105 includes input-output devices 600, a communication bus 605, a computing processor 610, and a memory system 620. The input-output devices 600, the computing processor 610, and the memory system 620 are coupled to the communication bus 605. The input-output devices 600 include a wireless communication node 615 (e.g., an 802.15.4 USB radio) and the display device 110, each of which is coupled to the communication bus 605. In various embodiments, the computing system 105 is a personal computer (PC), a laptop computer, or a wireless communication device, such as a mobile phone or portable media player.

The computing processor 610 may include any circuitry for processing the acceleration data generated by the wireless acceleration sensing device 170. For example, the computing processor 610 may be a microprocessor, an embedded processor, an embedded controller, a microcontroller, a synchronous logic circuit, an asynchronous logic circuit, a state machine, or the like, or some combination thereof.

The communication bus 605 may be any circuitry for facilitating communication among the input-output devices 600, the computing processor 610, and the memory system 620. For example, the communication bus 605 may be a computer bus and may include a separate data bus, memory bus, or input-output bus, or some combination thereof.

The memory system 620 may include any circuitry for storing data, such as the acceleration data generated by the wireless acceleration sensing device 170. For example, the memory system 620 may include a read-only memory (ROM), a random-access memory (RAM), a programmable read-only memory (PROM), an eraseable programmable read-only memory (EPROM), an electrically eraseable programmable read-only memory (EEPROM), a flash storage, a disk drive, or the like, or some combination thereof.

The wireless communication node 615 may be any circuitry for receiving the wireless communication signal 120 including the acceleration data from the wireless acceleration sensing device 170. For example, the wireless communication node 615 may be a radio receiver. In some embodiments, the wireless communication node 615 generates a wireless communication signal 120 including program data for programming the wireless acceleration sensing device 170. For example, the wireless communication node 615 may be a radio transceiver. In these embodiments, the wireless communication node 615 receives a wireless communication signal 120 including the acceleration data from the wireless acceleration sensing device 170 and sends a wireless communication signal 120 including the program data to the wireless acceleration sensing device 170.

In various embodiments, the wireless communication node 615 communicates with the wireless acceleration sensing device 170 via wireless communication signals 120 according to a wireless area network (WAN) standard or a personal wireless area network standard (PWAN). For example, the wireless communication node 615 may receive and generate a wireless communication signal 120 according to a Bluetooth standard, an Infrared Data Association (IrDA) standard, an ultra-wideband (UWB) standard, a Z-Wave standard, or a ZigBee standard. In some embodiments, the wireless communication node 615 is a radio receiver that receives the wireless communication signal 120 according to the IEEE 802.15.4-2003 standard for personal wireless networks. In some embodiments, the wireless communication node 615 is a radio transceiver that receives and transmits the wireless communication signal 120 according to the IEEE 802.15.4-2003 standard for personal wireless networks.

In operation, the wireless communication node 615 receives a wireless communication signal 120 including acceleration data for the billiard cue 160 from the wireless acceleration sensing device 170 and provides the acceleration data to the computing processor 610 via the communication bus 605. In turn, the computing processor 610 generates image data based on the acceleration data and provides the image data to the display device 110 via the communication bus 605. The display device 110 displays the image data in a visual format, such as a still image or a motion picture movie. In various embodiments, the image data includes a three-dimensional (3D) still image or a sequence of three-dimensional (3D) images, such as a motion picture movie.

In some embodiments, the computing processor 610 stores the acceleration data in the memory system 620 via the communication bus 605. In some embodiments, the wireless communication node 615 stores the acceleration data in the memory system 620 via the communication bus 605 and the computing processor 610 accesses the acceleration data from the memory system 620 via the communication bus 605.

In various embodiments, the image data includes images indicating the position of the billiard cue 160. For example, the image data may include one or more graphs indicating movement of the billiard cue 160 over time. In these embodiments, the computing processor 610 computes the position of the billiard cue 160 along one or more axes of a coordinate system based on the acceleration data. For example, the computing processor 610 may integrate the acceleration data to determine the velocity of the billiard cue 160 along each axis of the coordinate system and integrate the velocity along each axis to determine the corresponding position of the billiard cue 160 along that axis. In this way, the computing processor 610 processes the acceleration data.

In some embodiments, the computing processor 610 computes the position of the billiard cue 160 along two or more axes of the coordinate system and generates image data including a graph indicating the position of the billiard cue 160 along each axis of the coordinate system over time. In some embodiments, the computing processor 610 computes the position of the billiard cue 160 along two or more axes of the coordinate system and generates image data including a graph for each axis of the coordinate system indicating the position of the billiard cue 160 along that axis over time. In this way, the billiard cue stroke simulator 115 simulates the stroke of the billiard cue 160.

In some embodiments, the computing processor 610 generates image data including a motion picture movie based on the acceleration data. In these embodiments, the motion picture movie includes a representation of the billiard cue 160, such as a simulated image of the billiard cue 160, which indicates the position of the billiard cue 160 along two or more axes of the coordinate system over time. In this way, the billiard cue stroke simulator 115 simulates the stroke of the billiard cue 160. In further embodiments, the computing processor 610 generates image data including one or more graphs indicating the position of the billiard cue 160 along one or more axes of the coordinate system over time and a motion picture movie indicating the position of the billiard cue 160 along one or more axes of the coordinate system over time. For example, the display device 110 may display the graphs indicating the position of the billiard cue 160 over time and simultaneously display the motion picture movie indicating the position of the billiard cue 160 over time.

In some embodiments, the computing processor 610 processes the acceleration data in the wireless communication signal 120 received by the computing system 105. For example, the computing processor 610 may filter the acceleration data to smooth the acceleration measurements indicated by the acceleration data. As another example, the computing processor 610 may filter the acceleration data to remove noise from the acceleration data, such as noise in the acceleration measurements indicated by the acceleration data. In some embodiments, the computing processor 610 computes a maximum velocity of the billiard cue 160 and the display device 110 displays the maximum velocity. For example, the display device 110 may display a number indicating the maximum velocity of the billiard cue 160 or a graph of the velocity of the billiard cue 160 over time, or both.

In some embodiments, the computing processor 610 computes a maximum velocity of the cue ball 140 during a stroke of the billiard cue 160 based on the acceleration data. For example, the computing processor 610 may determine an initial velocity of the billiard cue 160 at a time of impact in which the billiard cue 160 strikes the cue ball 140 based on the acceleration data. Further, the computing processor 610 may compute the initial velocity (e.g., maximum velocity) of the cue ball 140 at the time of impact based on the velocity of the billiard cue 160 at the time of impact, the weight of the billiard cue 160, and the weight of the cue ball 140. In some embodiments, the computing processor 610 computes the initial velocity of the cue ball 140 at the time of impact based on conservation of energy. In these embodiments, the computing processor 610 computes the initial velocity of the cue ball 140 at the time of impact based on the velocity of the billiard cue 160 at the time of impact, the mass of the billiard cue 160, and the mass of the cue ball 140.

Figure 7:
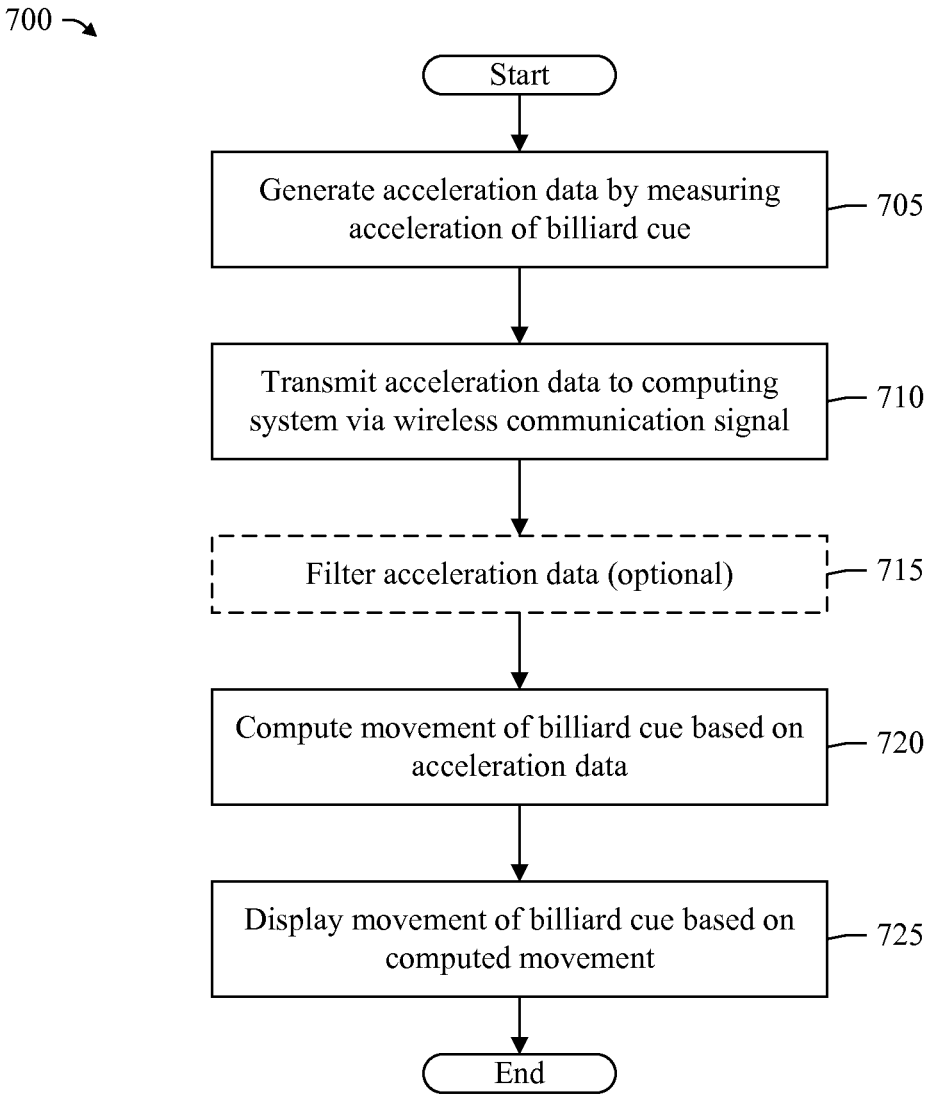
FIG. 7 is a flow chart of a method of simulating a billiard cue stroke, in accordance with an embodiment of the present invention.

FIG. 7 illustrates a method 700 of simulating a billiard cue stroke, in accordance with an embodiment of the present invention. In step 705, acceleration data is generated by measuring acceleration of a billiard cue. In various embodiments, the wireless acceleration sensing device 170 is attached to the billiard cue 160 and measures acceleration of the billiard cue 160. Further, the wireless acceleration sensing device 170 generates acceleration data based on the measured acceleration of the billiard cue 160. In some embodiments, the accelerometer 400 generates the acceleration data based on the measured acceleration of the billiard cue 160. In other embodiments, the low-g accelerometer 500 and the high-g accelerometer 505 together generate the acceleration data based on the measured acceleration of the billiard cue 160. The method 700 then proceeds to step 710.

In step 710, the acceleration data is transmitted to a computing system via a wireless communication signal. In various embodiments, the wireless acceleration sensing device 170 transmits a wireless communication signal 120 including the acceleration data to the computing system 105. In some embodiments, the computing processor 410 receives the acceleration data from the accelerometer 400 and provides the acceleration data to the wireless communication node 415. In turn, the wireless communication node 415 generates the wireless communication signal 120 including the acceleration data and transmits the wireless communication signal 120 to the computing system 105. In further embodiments, the computing processor 410 processes the acceleration data received from the accelerometer 400 before providing the acceleration data to the wireless communication node 415.

In some embodiments, the computing processor 510 receives the acceleration data from both the low-g accelerometer 500 and the high-g accelerometer 505 and provides the acceleration data to the wireless communication node 515. In turn, the wireless communication node 515 generates the wireless communication signal 120 including the acceleration data and transmits the wireless communication signal 120 to the computing system 105. In these embodiments, the acceleration data includes both low-g acceleration data and high-g acceleration data. In further embodiments, the computing processor 510 processes the acceleration data received from the low-g accelerometer 500 and the high-g accelerometer 505 before providing the acceleration data to the wireless communication node 515. The method 700 then proceeds to step 715.

In optional step 715, the acceleration data is filtered. In various embodiments, tithe computing processor 610 filters the acceleration data in the wireless communication signal 120 received by the computing system 105. For example, the computing processor 610 may filter the acceleration data to smooth the acceleration measurements indicated by the acceleration data. As another example, the computing processor 610 may filter the acceleration data to remove noise from the acceleration data, such as noise in the acceleration measurements indicated by the acceleration data. The method 700 then proceeds to step 720.

In step 720, the movement of the billiard cue is computed based on the acceleration data. In various embodiments, the computing processor 610 computes the movement of the billiard cue 160 along two or more axes of a coordinate system based on the acceleration data in the wireless communication signal 120 received by the computing system 105. For example, the computing processor 610 may compute the velocity of the billiard cue 160 along each axis of the coordinate system over time by integrating acceleration measurements of the billiard cue 160 along the axis as indicated by the acceleration data. Further, the computing processor 610 may compute the position of the billiard cue 160 along each axis over time by integrating the computed velocity of the billiard cue 160 along the axis. Moreover, the computing processor 610 generates image data based on the computed positions of the billiard cue 160 indicating the movement of the billiard cue 160 over time. For example, the image data may include graphs indicating the position of the billiard cue 160 along one or more axes of a coordinate system over time. As another example, the image data may include a motion picture movie including a representation of the billiard cue 160 and the position of the representation of the billiard cue 160 over time. The method 700 then proceeds to step 725.

In step 725, the movement of the billiard cue is displayed based on the computed movement. In various embodiments, the display device 110 of the computing system 105 displays the movement of the billiard cue 160 based on the computed movement. For example, the display device 110 may display the image data generated by the computing processor 610, which indicates movement of the billiard cue 160. In various embodiments, the display device 110 displays still images, such as graphs, or moving images, such as a motion picture movie, based on the image data, or both. In some embodiments, the display device 110 displays one or more graphs indicating the position of the billiard cue 160 along the three axes of an x-y-z coordinate system and simultaneously displays a motion picture motive showing the position of a representation of the billiard cue 160 in the x-y-z coordinate system over time. The method 700 then ends.

In various embodiments, the method 700 may include more or fewer than the steps 705-725 described above and illustrated in FIG. 7. In some embodiments, the steps 705-725 of the method 700 may be performed in a different order than that described above and illustrated in FIG. 7. In various embodiments, some of the steps 705-725 may be performed in parallel or substantially simultaneously.

Although the invention has been described with reference to particular embodiments thereof, it will be apparent to one of ordinary skill in the art that modifications to the described embodiment may be made without departing from the spirit of the invention. Accordingly, the scope of the invention will be defined by the attached claims not by the above detailed description.

What is claimed is:

1. A billiard cue stroke simulator, comprising:

a wireless acceleration sensing device for attaching to a billiard cue, the wireless acceleration sensing device configured to generate acceleration data indicating acceleration of the billiard cue during a stroke of the billiard cue and generate a wireless communication signal including the acceleration data; and a computing system configured to receive the wireless communication signal and generate image data indicating movement of the billiard cue based on the acceleration data in the wireless communication signal, the computing system further configured to display at least one image indicating movement of the billiard cue based on the image data.

2. The billiard cue stroke simulator of claim 1, wherein the computing system comprises a wireless communication node for receiving the wireless communication signal generated by the wireless acceleration sensing device, and wherein the wireless acceleration sensing device comprises:

an accelerometer configured to generate the acceleration data by measuring acceleration of the billiard cue along at least two axes of a coordinate system;

a computing processor coupled to the accelerometer and configured to receive the acceleration data from the accelerometer; and a wireless communication node coupled to the computing processor and configured to receive the acceleration data from the computing processor and generate the wireless communication signal indicating the acceleration data.

3. The billiard cue stroke simulator of claim 2, wherein the at least one image comprises at least one graph indicating the position of the billiard cue over time along each axis of the at least two axes of the coordinate system.

4. The billiard cue stroke simulator of claim 2, wherein the at least one image indicates movement of a simulated billiard cue representing movement of the billiard cue over time along the at least two axes of the coordinate system.

5. The billiard cue stroke simulator of claim 4, wherein the at least one image indicates movement of the simulated billiard cue in three dimensions.

6. The billiard cue stroke simulator of claim 1, wherein the computing system comprises a wireless communication node for receiving the wireless communication signal generated by the wireless acceleration sensing device, and wherein the wireless acceleration sensing device comprises:

a low-g accelerometer configured to generate low-level acceleration data by measuring acceleration of the billiard cue along at least one axis of a coordinate system;

a high-g accelerometer configured to generate high-level acceleration data by measuring acceleration of the billiard cue along at least one axis of the coordinate system;

a computing processor coupled to the low-g accelerometer and the high-g accelerometer and configured to receive the low-level acceleration data from the low-g accelerometer and the high-level accelerometer data from the high-g accelerometer; and a wireless communication node coupled to the computing processor and configured to receive the acceleration data from the computing processor and generate the wireless communication signal indicating the acceleration data, the acceleration data including both the low-level acceleration data and the high-level acceleration data.

7. The billiard cue stroke simulator of claim 6, wherein the low-g accelerometer and the high-g accelerometer in combination are further configured to generate the acceleration data by measuring acceleration of the billiard cue along at least two axes of the coordinate system.

8. The billiard cue stroke simulator of claim 7, wherein the at least one image comprises at least one graph indicating the position of the billiard cue over time along each axis of the at least two axes of the coordinate system.

9. The billiard cue stroke simulator of claim 7, wherein the at least one image indicates movement of a simulated billiard cue representing movement of the billiard cue over time along the at least two axes of the coordinate system.

10. A billiard cue stroke simulator, comprising:

means for generating acceleration data indicating acceleration of a billiard cue during a stroke of the billiard cue;

means for generating a wireless communication signal including the acceleration data;

means for generating image data indicating movement of the billiard cue based on the acceleration data in the wireless communication signal; and means for displaying at least one image indicating movement of the billiard cue along at least two axes of the coordinate system based on the image data.

11. The billiard cue stroke simulator of claim 10, wherein the at least one image comprises at least one graph indicating the position of the billiard cue over time along each axis of the at least two axes of the coordinate system.

12. The billiard cue stroke simulator of claim 10, wherein the at least one image indicates movement of a simulated billiard cue representing movement of the billiard cue over time along the at least two axes of the coordinate system.

13. The billiard cue stroke simulator of claim 12, wherein the at least one image indicates movement of the simulated billiard cue in three dimensions.

14. The billiard cue stroke simulator of claim 10, wherein the acceleration data includes low-level acceleration data and high-level acceleration data, the billiard cue stroke simulator further comprising:

means for generating the low-level acceleration data by measuring acceleration of the billiard cue along at least one axis of a coordinate system; and means for generating the high-level acceleration data by measuring acceleration of the billiard cue along at least one axis of the coordinate system.

15. The billiard cue stroke simulator of claim 14, wherein the at least one image comprises at least one graph indicating the position of the billiard cue over time along each axis of the at least two axes of the coordinate system.

16. The billiard cue stroke simulator of claim 14, wherein the at least one image includes a simulated billiard cue representing the billiard cue and shows movement of the simulated billiard cue representing movement of the billiard cue over time along the at least two axes of the coordinate system.

17. A method of simulating a billiard cue stroke, the method comprising:

generating acceleration data indicating acceleration of a billiard cue during a stroke of the billiard cue;

generating a wireless communication signal including the acceleration data;

generating image data indicating movement of the billiard cue based on the acceleration data in the wireless communication signal; and displaying at least one image indicating movement of the billiard cue along at least two axes of the coordinate system based on the image data.

18. The method of claim 17, wherein the at least one image indicates movement of a simulated billiard cue representing movement of the billiard cue over time along the at least two axes of the coordinate system.

19. The method of claim 17, wherein the at least one image comprises at least one graph indicating the position of the billiard cue over time along each axis of the at least two axes of the coordinate system.

20. The method of claim 19, wherein the at least one image indicates movement of the simulated billiard cue in three dimensions.

21. The method of claim 17, wherein the acceleration data includes low-level acceleration data and high-level acceleration data, the method further comprising:

generating the low-level acceleration data by measuring acceleration of the billiard cue along at least one axis of a coordinate system; and generating the high-level acceleration data by measuring acceleration of the billiard cue along at least one axis of the coordinate system.

22. The method of claim 21, wherein the at least one image comprises at least one graph indicating the position of the billiard cue over time along each axis of the at least two axes of the coordinate system.

23. The method of claim 21, wherein the at least one image indicates movement of a simulated billiard cue representing movement of the billiard cue over time along the at least two axes of the coordinate system.

* * * * *